US006302534B1

(12) United States Patent
Tsukahara et al.

(10) Patent No.: US 6,302,534 B1
(45) Date of Patent: Oct. 16, 2001

(54) METHOD FOR RECYCLING INK CARTRIDGE USED FOR RECORDING APPARATUS

(75) Inventors: Michinari Tsukahara; Hisashi Koike; Yukiharu Suda; Satoshi Shinada, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/469,279

(22) Filed: Dec. 22, 1999

(30) Foreign Application Priority Data

Dec. 22, 1998 (JP) ..... 10-364134
Dec. 17, 1999 (JP) ..... 11-358714

(51) Int. Cl.[7] ..... B41J 2/175
(52) U.S. Cl. ..... 347/86
(58) Field of Search ..... 347/84, 85, 86, 347/87, 28

(56) References Cited

U.S. PATENT DOCUMENTS 4,824,487 * 4/1989 Heffernan ..... 134/10
5,182,579 * 1/1993 Haruta et al. ..... 347/87
5,683,520 * 11/1997 Edgett et al. ..... 134/22.19
5,707,456 * 1/1998 Komplin et al. ..... 134/22.18
6,086,191 * 7/2000 Yano et al. ..... 347/85

FOREIGN PATENT DOCUMENTS 0 581 531 B1 6/1998 (EP) ..... B41J/2/175
7-60979 3/1995 (JP) ..... B41J/2/175
7-309017 11/1995 (JP) ..... B41J/2/175
7-323560 12/1995 (JP) ..... B41J/2/175

* cited by examiner

*Primary Examiner*—Judy Nguyen
(74) *Attorney, Agent, or Firm*—Sughrue, Mion, Zinn, Macpeak & Seas, PLLC

(57) ABSTRACT

A method, for recycling an ink cartridge used for a recording apparatus, comprises the steps of: discharging residual ink from an ink cartridge wherein a porous member is retained for the absorption of ink; using a cleansing fluid to clean the porous member; discharging the cleansing fluid from the porous member; and impregnating the porous member with ink.

30 Claims, 7 Drawing Sheets

METHOD FOR RECYCLING INK CARTRIDGE USED FOR RECORDING APPARATUS

BACKGROUND OF THE INVENTION

The present invention relates to a recycling technique of an ink cartridge for an ink-jet recording apparatus, in which the resupply of ink is effected by the replacement of the cartridge. The present invention is particularly applicable, but not limited to, an ink-jet recording apparatus of a type in which an ink-jet recording head and an ink cartridge are mounted on a carriage.

An ink-jet recording apparatus is known in which an ink container is attached to a carriage having an ink-jet recording head mounted thereon. In order to prevent printing failures associated with water head pressure change and air bubble generation due to agitation of ink by the carriage movement, it is preferable to accommodate a porous member at least in an ink supply port of the ink container, as disclosed in European Patent Publication No. 581531.

This arrangement can solve the above-mentioned problems linked with the ink agitation since the ink is supplied to the recording head via the porous member.

The recycling of ink cartridges is a desirable objective, and is in consonance with the current trend of effectively conserving resources and reducing the amount of pharmaceutical agents that are discharged to the environment. Japanese Unexamined Patent Publication No. Hei 7-60979 discloses an ink cartridge recycling apparatus having an annular member provided with a rotatable ink chamber. An ink cartridge is mounted on the annular member so that the ink supply port faces outward while an ink supply tube is connected to a lid side of the ink cartridge, and then the annular member is rotated in that state.

This apparatus makes it possible to fill new ink into a collected ink cartridge while discharging the remaining old ink from the collected ink cartridge using centrifugal force produced by the rotation of the annular member.

This apparatus, however, suffers from a problem in that the size of the apparatus is large because centrifugal force must be employed. Further, ink may not be completely discharged by the centrifugal force because of strong capillary attraction originating in the porous member contained in an ink cartridge, and/or because of solidification or increased viscosity of the ink. Consequently, refilled new ink is mixed with old ink to lower printing quality, and this is a serious problem, in particular, in case of ink cartridges for color printing.

It is conceivable to remove the porous member from the cartridge and then clean the cartridge sufficiently. The disassembly and the reassembly of cartridge is, however, required to increase the cost.

SUMMARY OF THE INVENTION

Therefor, an objective of the present invention is to provide a method for recycling an ink cartridge, which does not require the disassembly of an ink cartridge and which can provide a refilled ink cartridge ensuring high quality printing.

In the method of the present invention, a porous member in an ink cartridge is cleansed by cleansing fluid. Further, the cleansing fluid is discharged from the porous member. Therefore, new ink is neither mixed with residual ink nor cleansing fluid. The ink cartridge, after recycling, can provide the same quality as a brand-new cartridge.

Preferably, a method for recycling an ink cartridge for a recording apparatus according to the present invention comprising the steps of:

discharging residual ink from an ink cartridge in which a porous member for ink absorption is accommodated;

cleansing the porous member using cleansing fluid;

discharging the cleansing fluid from the porous member; and impregnating the porous member with ink.

Therefore, refilling of ink can be carried out with the porous member accommodated in the ink cartridge and without disassembly of the ink cartridge. The cleansing fluid can completely remove any residual ink. Thus, an ink cartridge can be recycled at a low cost, and the same quality can be provided as that provided by a brand new one, without any contamination.

The present disclosure relates to the subject matter contained in Japanese patent application Nos. Hei. 10-364143 (filed on Dec. 22, 1998), and Hei. 11-358714 (filed on Dec. 17, 1999), all of which are expressly incorporated herein by reference in their entireties.

DESCRIPTION OF THE PREFERRED EMBODIMENT

Figure 1:
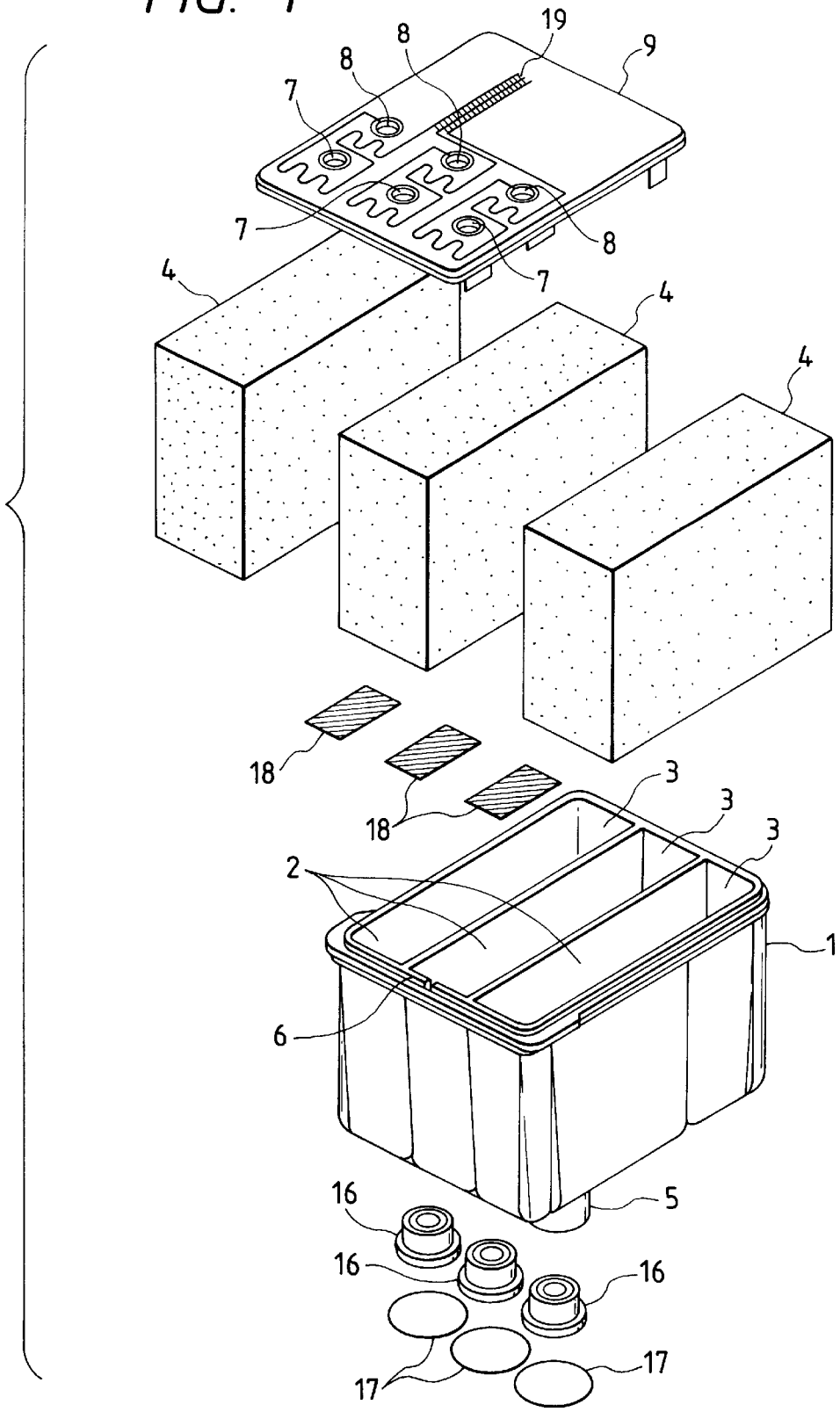
FIG. 1 is an exploded perspective view of an ink cartridge according to one embodiment of the present invention for which the recycling method of the present invention can be employed.
Figure 2:
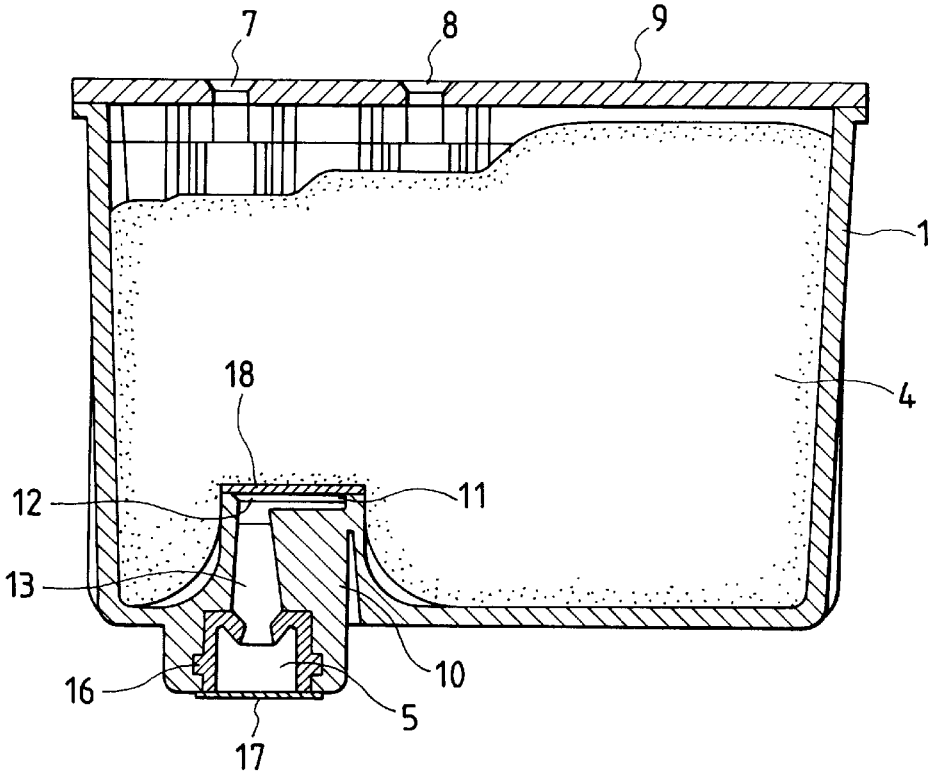
FIG. 2 is a cross-sectional view of the structure of the ink cartridge.

FIGS. 1 and 2 are diagrams showing an ink cartridge, according to one embodiment of the present invention, for which a manufacturing method of this invention is applied. A container 1, having a substantially rectangular, parallelpiped shape, is formed by the injection of a polymer material, with the open side being slightly larger than the opposite side. The container 1 has walls 2 defining a plurality of ink chambers 3. In each of the ink chamber 3, a porous member 4, made of a flexible material that is appropriate for ink absorption is accommodated in a compressed state. Formed at the bottom end of each chamber 3, is an ink supply port 5 which receives an ink supply needle or ink supply tube of a recording head. An opening 6 is sealingly closed by a lid 9 having ink introduction holes 7 and air communication holes 8.

A projecting portion 10 is provided for each ink chamber 3 to compress the porous member 4 in the vicinity of the ink supply port 5. The upper end of the projection portion 10 is formed into a recessed portion 12 that defines a chamber 11 having a predetermined opening area. A through-hole 13 extends from the chamber 11 to the ink supply port 5. A packing 16 is fitted on the outer end portion of the through-hole 13. The packing 16 is adapted to hermetically engage the ink supply needle or ink supply tube of the recording head. A gas impermeable film 17 is attached to cover the ink supply port 5. The film 17 is made, for example, of a low density polyethylene film having low moisture permeability, and can be broken upon the ink supply needle is inserted into the ink supply port 5. Reference numeral 18 in FIGS. 1 and 2 denotes a filter member that is provided to cover the recessed portion 12.

Figure 3:
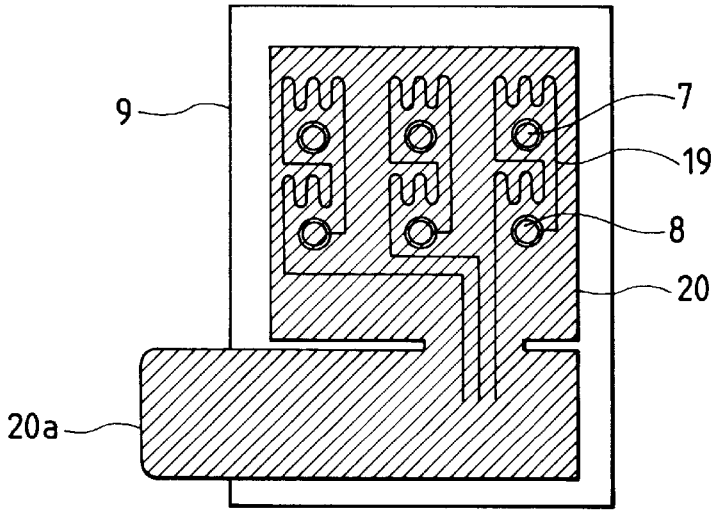
FIG. 3 is a top view of the structure of a lid of the ink cartridge.

As shown in FIG. 3, meandering grooves 19 are formed in the upper surface of the lid 9, each of which is communicated at its one end with a corresponding air communication hole 8. The other end of each meandering groove 19 is extended to the lower side of the lid 9 in FIG. 3. A film 20 is attached to the lid 9 to cover a hatched area. The lower half of the film 20 in FIG. 3 can be peeled off by lifting a tongue piece 20*a*.

The re-filling method will now be described.

Figure 4:
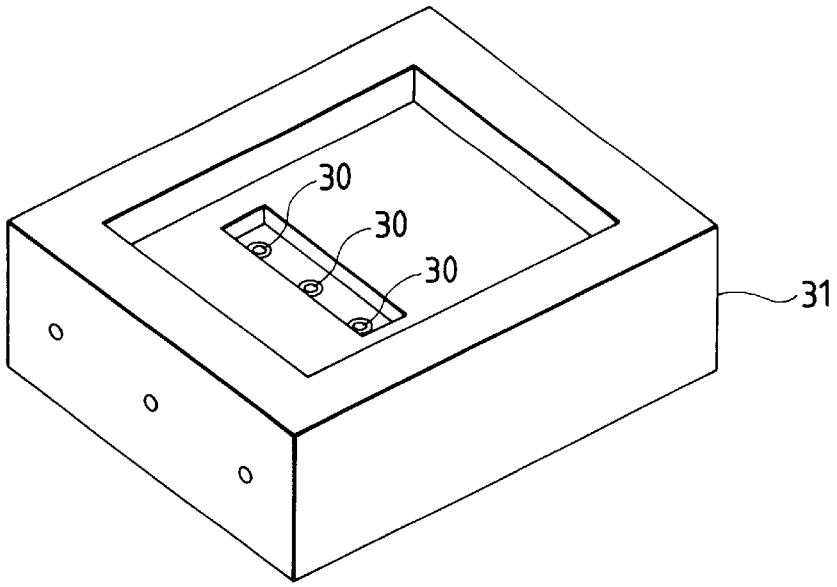
FIG. 4 is a diagram showing an example of a work table that is used at an ink discharge step in an ink cartridge recycling process.

The surface of an ink cartridge collected from a user is cleaned, and the films 17 and 20 are peeled off from the ink supply ports 5 and the lid 9. Then, the ink cartridge is set on a work table 31 in which suction ports 30 are formed as shown in FIG. 4 to engage the ink supply ports 5.

Figure 5:
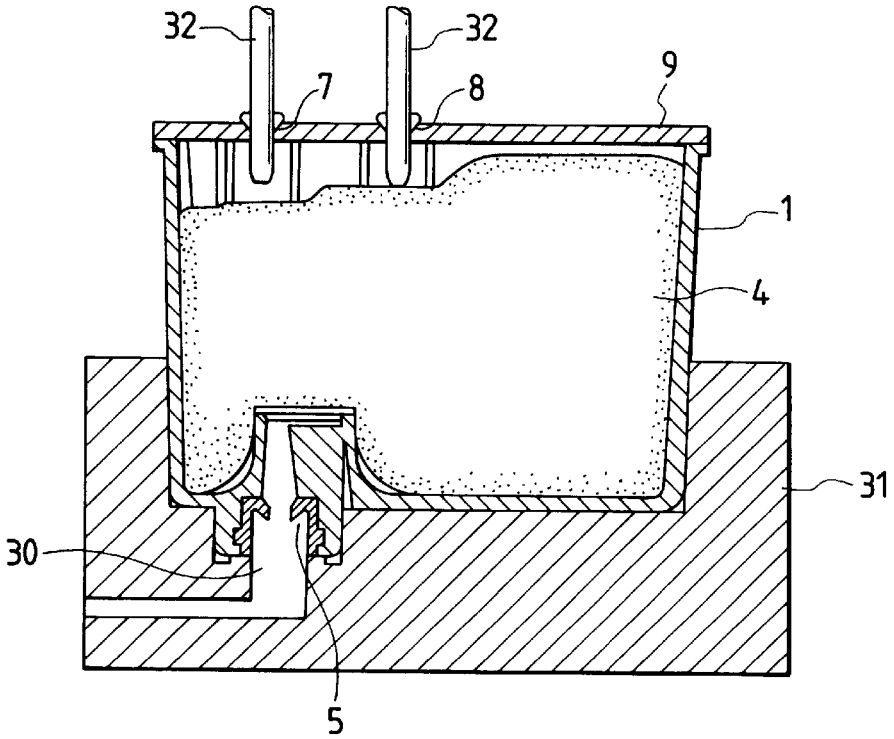
FIG. 5 a cross-sectional view for explaining a step during which residual ink is discharged.

As shown in FIG. 5, negative pressure is applied to the ink supply ports 5 by an ink suction device that communicates with the suction ports 30, so that ink remaining in the porous members 4, etc. is removed by suction.

Hollow needles 32, which communicate with a device for supplying a cleansing fluid that is, for example, refined water, a solvent, a constituent of ink, are abutted upon or inserted into the ink introduction holes 7 and the air communication holes 8 in the lid 9 to introduce the cleansing fluid of an amount required to impregnate the porous members 4, preferably 1 to 15 times of the amount, more preferably 3 times or greater of the amount. As a result, the cleansing fluid flowing from the top of the cartridge permeates the porous members 4, and then flows out of the ink supply ports 5 to the suction ports 30 while diluting and dispersing the residual ink.

After the cleansing step ends, the cleansing fluid is discharged from the porous members 4. The cleansing fluid discharge step is preferably carried out such that negative pressure is applied to the ink supply ports 5 so that the cleansing fluid is forcibly extracted by suction.

More preferably, each of the cleansing step and the cleansing fluid discharge step is divided into plural sub-steps, so that the cleansing substeps and the cleansing fluid discharge sub-steps are carried out alternately. In other words, a required amount of the cleansing fluid to be introduced during the cleansing step is divided, so that the cleansing step is carried out plural times each followed by a cleansing fluid discharge step using suction. Further, it is also preferable and effective to vary the amount of cleansing fluid and the inflow rate of the cleansing fluid depending on the number of times the cleansing has been carried out, i.e., the degree of cleansing achieved. Moreover, an amount or flow rate of the cleansing fluid supplied during one cleansing sub-step may be different from an amount or flow rate supplied during another cleansing sub-step.

Thereafter, the cleansing fluid retained by capillary attraction in the porous members 4 is removed by natural drying, ventilation drying or decompression drying. That is, the ink cartridge is maintained at room temperature, dry air is introduced via the ink introduction holes 7 and the air communication holes 8 of the lid 9, or via the ink supply ports 5, the ink cartridge is placed in a decompression chamber, etc.

More preferably, the cleansing fluid retained by capillary attraction is volatilized by heating the ink cartridge for a predetermined period of time, e.g., for one day, at a temperature, e.g., 60° C., at which no deterioration of the porous members 4 occurs. This makes it possible to easily and surely remove the cleansing fluid from the porous members 4 without any great change to the manufacturing line. Thus, productivity can be improved.

Still more preferably, after the cleansing fluid has been discharged from the porous members 4, the ink cartridge is heated for approximately 24 hours at a temperature of approximately 60° C. Then, the ink cartridge is placed in a vacuum chamber for vacuum drying until the cleansing fluid is reduced to approximately 0.4 g per 80 g of the porous member 4.

After the cleansing fluid has been discharged, the ink supply ports 5 of the ink cartridge are sealed by attaching to them gas-impermeable films 17, respectively. It is also preferable that the packing 16 be replaced with new one at this time. The replacement of the packing 16 that has been thermally deteriorated during the cleansing step or the cleaning fluid discharge step with new one improves the reliability or quality of the recycled product.

Figure 6:
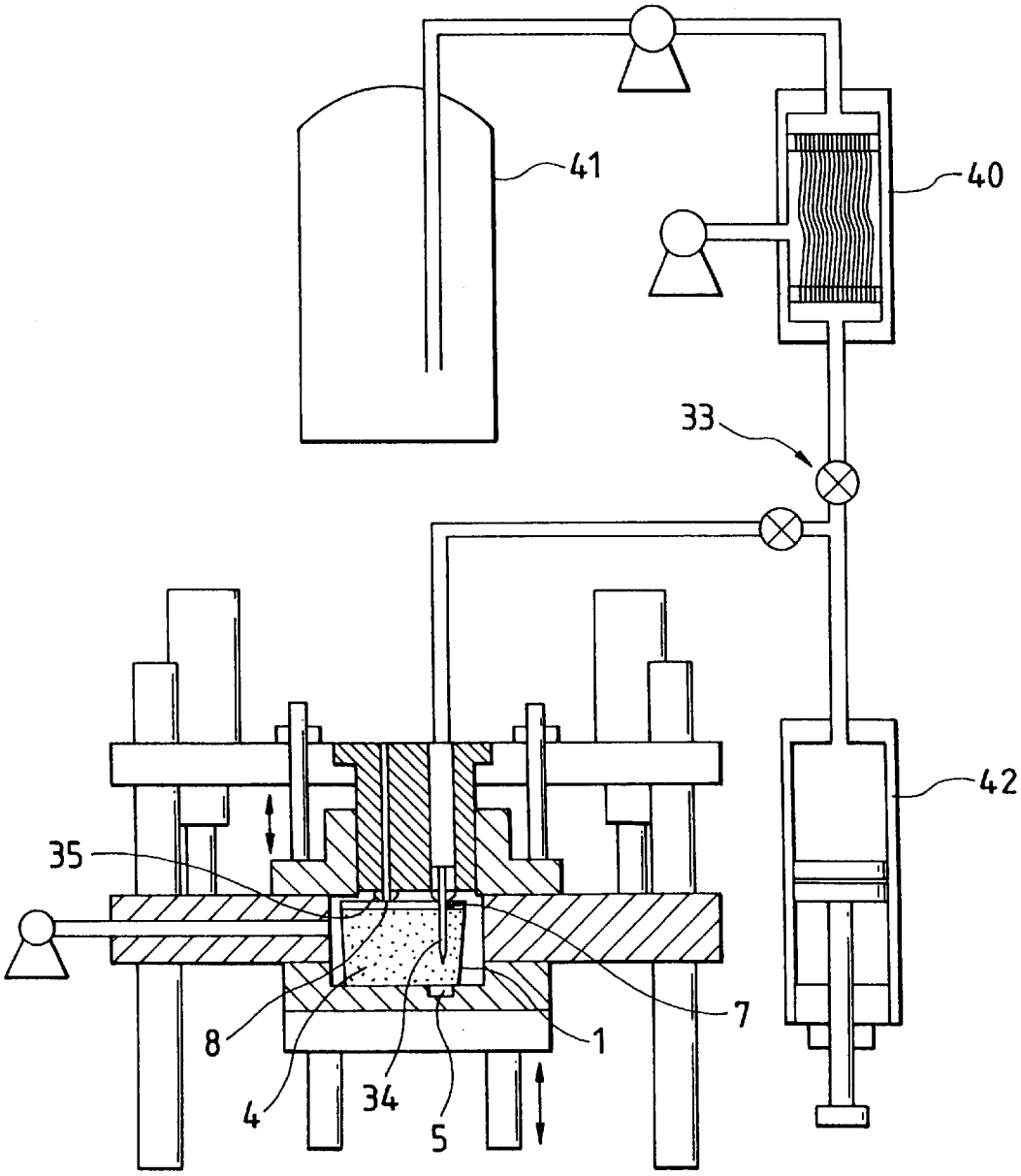
FIG. 6 is a diagram showing the structure of an ink filling device.

As shown in FIG. 6, an introduction tube 34 that communicates with an ink supply unit 33 is inserted through the ink introduction hole 7 into the porous member 4. A discharge tube 35, which communicates with a vacuum pump, is connected to the air communication hole 8. While removing air from the upper space of the cartridge, a predetermined amount of degassed ink is introduced into the porous member 4 from a metering pipe 42 to which ink from a tank 41 has been preliminarily supplied via a degassing unit 40.

In a case where an ink cartridge is recycled to an ink cartridge having the same specifications as the former ink cartridge, it is preferable that the density of effective ink constituent elements, such as pigments, dyes, surface-active agents or moisture solvents, be slightly reduced. That is, since the porous member of the ink cartridge has been so impregnated with the effective constituent elements of the initially filled ink that those elements can no further be dissolved, the effective constituent elements of the ink used for re-filling will not be absorbed by the porous member 4, and the density of the ink will not be reduced.

Subsequently to filling the ink of a predetermined amount, the gas-impermeable film 20 is attached to the surface of the lid 9 to seal the ink introduction holes 7, the air communication holes 8, and the grooves 19.

Figure 7:
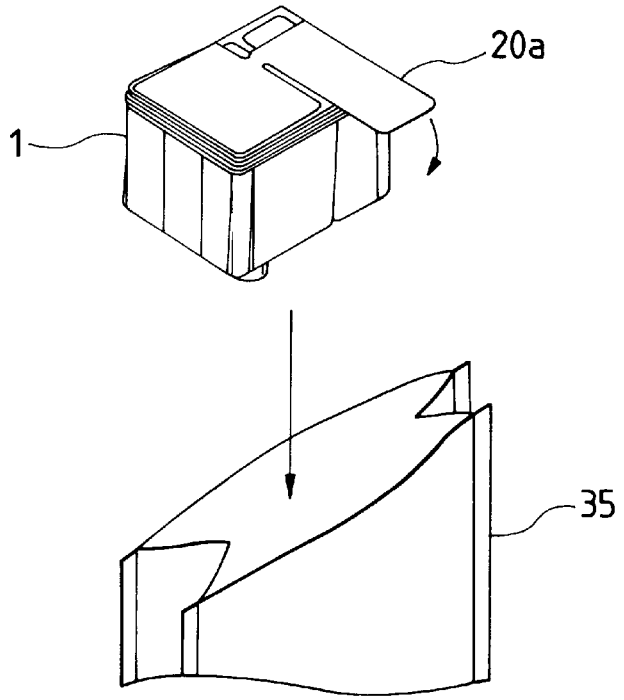
FIG. 7 is a diagram showing the first half of a packaging step for a recycled ink cartridge.

Then, as shown in FIG. 7, the tongue piece 20*a* of the film 20 is folded down and the container 1 is inserted into a bag 35 formed of an air-impermeable film.

Figure 8:
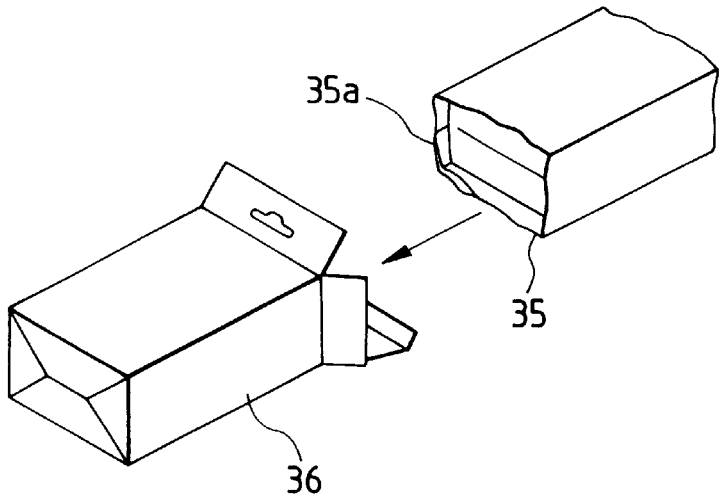
FIG. 8 is a diagram showing the second half of the packaging step for the recycled ink cartridge.

An opening 35*a* is thereafter closed by heat sealing in a reduced-pressure environment. As shown in FIG. 8, the bag 35 is then stored in a case 36 on which the trademark of the recycling company is displayed. In this fashion, the production of the product is completed.

Figure 9:
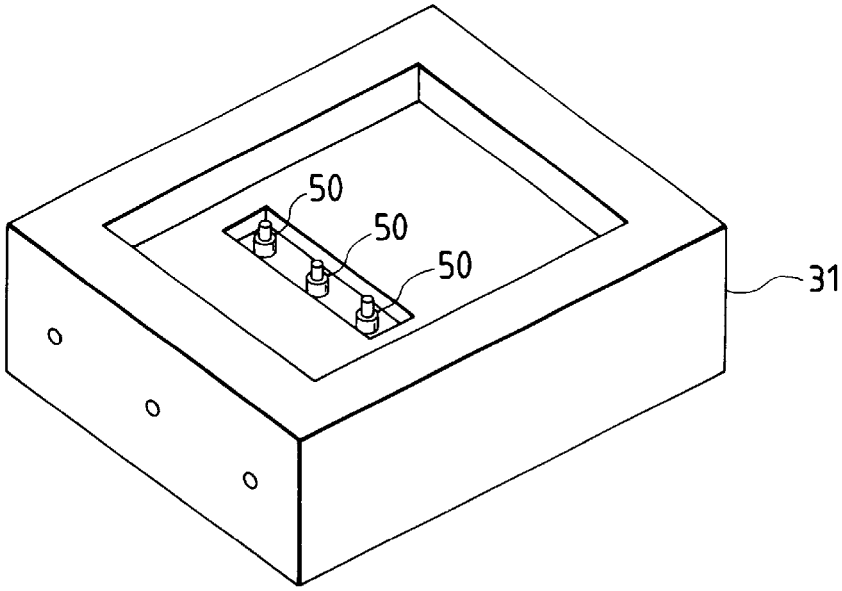
FIG. 9 is a diagram showing another example of a work table used in the cartridge recycling process.
Figure 10:
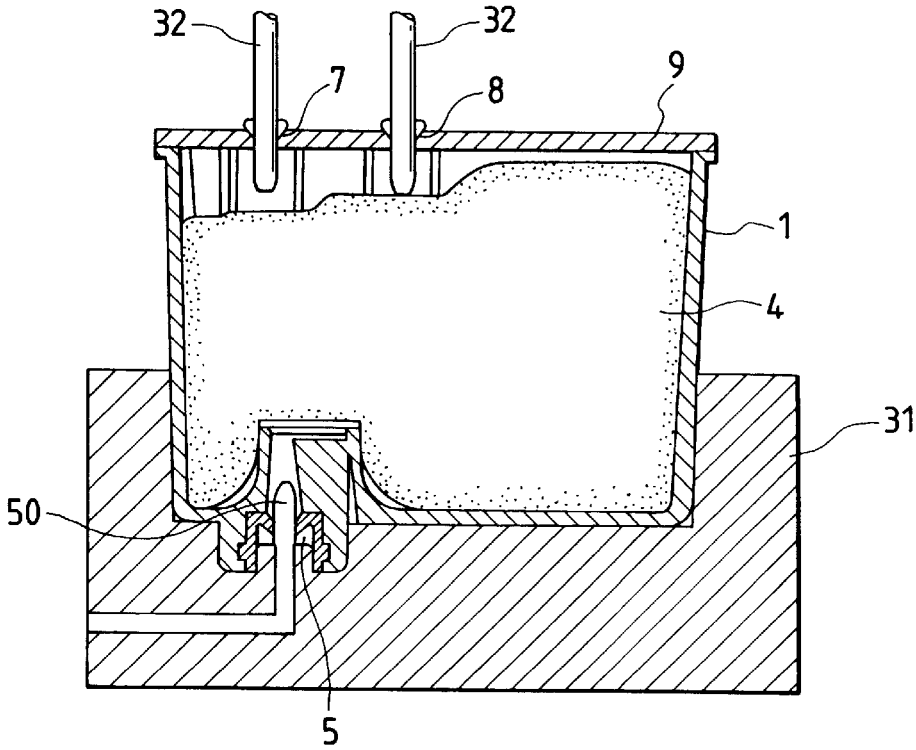
FIG. 10 is a diagram showing the residual ink discharging step using the work table.

If the suction ports are formed as hollow needles 50 as shown in FIG. 9, then, as is shown in FIG. 10, the hollow needles 50 can be inserted into the ink supply ports 5 in the same manner as when the ink cartridge is mounted on a recording head, and the cleansing fluid can be drawn out.

Figure 11:
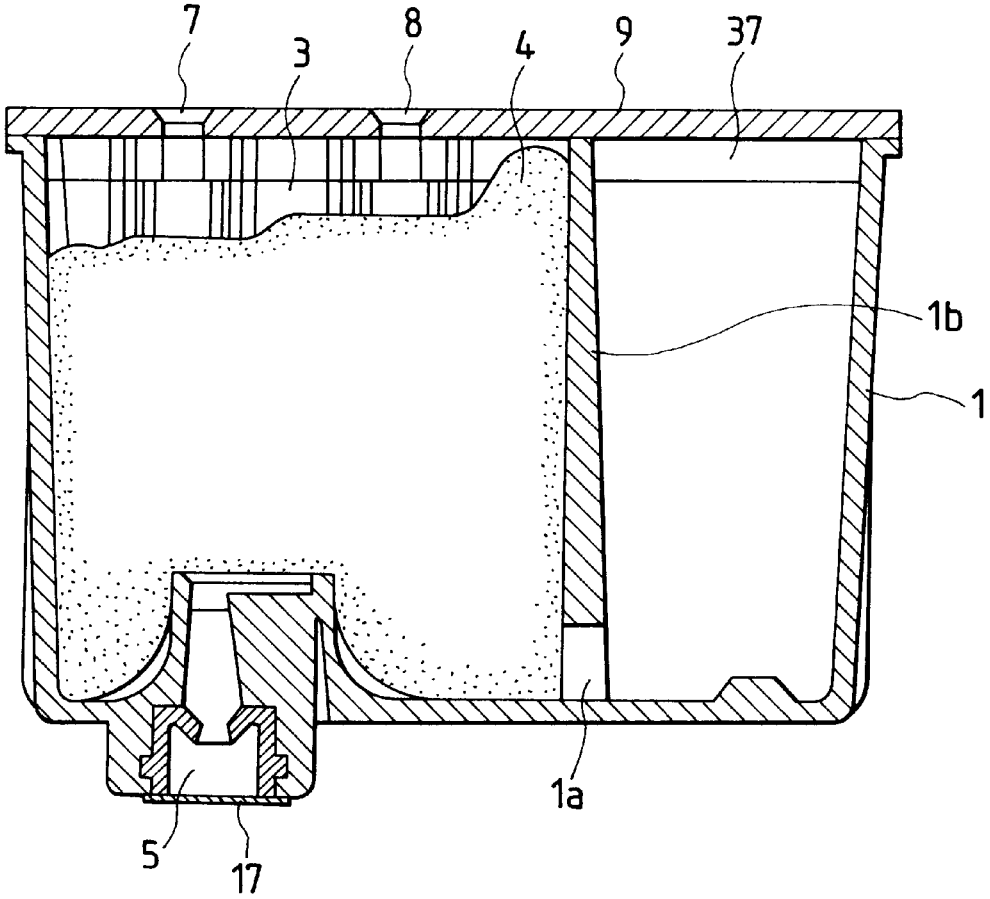
FIG. 11 is a diagram showing an ink cartridge according to another embodiment for which the present invention can be applied.

In the above description, an ink cartridge in which all ink is impregnated in the porous members 4 has been explained. The same effects can be obtained by applying the recycling process of the present invention to an ink cartridge shown in FIG. 11, in which a form chamber 3 is divided by a wall 1*b* having a communication hole 1*a* to have an ink chamber 37.

In the above description, the film 17 is attached to the ink supply port 5 to seal the ink supply port 5. The present invention is not restricted thereto or thereby. For example, the packing member 16 per se may have the sealing function for the ink supply port 5, or an integrally formed member having both the sealing function and the packing function may be used. In this case, it is preferable to detach the packing member 16 or the integrally formed member from the ink supply port 5 prior to the negative pressure applying step, and to attach the packing member 16 or the integrally formed member to the ink supply port 5 (or to attach a new packing member 16 or a new integrally formed member to the ink supply port 5) prior to the ink refilling step.

What is claimed is:

1. A method for recycling an ink cartridge having an ink supply port to be communicated with a recording head of a recording apparatus, comprising the steps of:

discharging residual ink from an ink cartridge in which a porous member for ink absorption is retained;

cleansing said porous member by introducing a cleansing fluid into said cartridge;

discharging said cleansing fluid from said porous member through a suction port connected to the ink supply port without interposing the recording head between the suction and supply ports; and impregnating said porous member with ink.

2. A method according to claim 1, wherein said step of discharging said cleansing fluid includes drying said porous member under a natural condition.

3. A method according to claim 1, wherein said step of discharging said cleansing fluid includes heating said porous member under a temperature causing no deterioration on said porous member.

4. A method according to claim 1, wherein said step of discharging said cleansing fluid includes drying said porous member under a vacuum condition.

5. A method according to claim 1, wherein said step of discharging said cleansing fluid includes thermally drying said porous member and thereafter placing said porous member under a reduced-pressure condition.

6. A method according to claim 1, wherein said cleansing fluid includes a solvent used as a component of said ink.

7. A method according to claim 1, wherein an amount of said cleansing fluid supplied during said cleansing step is at least 1 to 15 times as large as an amount of ink initially filled in the ink cartridge.

8. A method according to claim 7, wherein said amount of said cleansing fluid is divided so that said cleansing step is carried out plural times each followed by a suction step in which said cleansing fluid is discharged by suction.

9. A method according to claim 1, wherein said step of impregnating includes supplying ink effective constituent elements of which is lower in density than those of ink initially filled in the ink cartridge.

10. A method according to claim 1, wherein each of said cleansing step and said cleansing fluid discharging step is divided into plural sub-steps, and said cleansing sub-steps and said cleansing fluid discharging sub-steps are alternately carried out.

11. A method according to claim 10, wherein an amount of said cleansing fluid supplied during one of said cleansing sub-step is different from an amount of said cleansing fluid supplied during another of said cleansing sub-step.

12. A method according to claim 10, wherein a flow rate of said cleansing fluid supplied during one of said cleansing sub-step is different from a flow rate of said cleansing fluid supplied during another of said cleansing sub-step.

13. A method according to claim 1, wherein said cleansing step and said cleansing fluid discharging step are carried out simultaneously.

14. A method according to claim 1, wherein said cleansing fluid includes one of refined water, a solvent and a constituent of ink.

15. An ink cartridge recycling method applicable to an ink cartridge accommodating a porous member therein and having an ink supply port in one side to be communicated with a recording head of a recording apparatus, and an ink introduction hole and an air communication hole in another side, said method comprising the steps of:

applying a negative pressure to said ink supply port to discharge residual ink using suction;

introducing into said cartridge a cleansing fluid through at least one of said ink introduction hole and said air communication hole while applying a negative pressure to said ink supply port;

discharging said cleansing fluid absorbed in said porous member using a negative pressure through a suction port connected to the ink supply port without interposing the recording head between the suction and supply ports, and heating said porous member under a temperature causing no deterioration on said porous member to volatilize said cleansing fluid; and refilling ink through said introduction hole while expelling air through said air communication hole.

16. The method according to claim 15, further comprising:

a step of peeling a sealing film from said ink cartridge prior to negative pressure applying step.

17. The method according to claim 15, further comprising:

a step of attaching a sealing film to said ink supply port subsequently to said cleansing fluid discharging step and prior to said ink refilling step.

18. The method according to claim 17, wherein said sealing film has low moisture permeability.

19. The method according to claim 17, wherein said sealing film is gas-impermeable.

20. The method according to claim 15, further comprising:

a step of sealing said air communication hole and said ink introduction hole with a film subsequently to said ink refilling step.

21. The method according to claim 15, wherein said cleansing fluid includes a solvent used as a component of said ink.

22. The method according to claim 15, wherein an amount of said cleansing fluid supplied during said cleansing fluid introducing step is at least 1 to 15 times as large as an amount of ink initially filled in the ink cartridge.

23. The method according to claim 22, wherein said amount of said cleansing fluid is divided so that said cleansing step is carried out plural times each followed by a suction step in which said cleansing fluid is discharged by suction.

24. The method according to claim 15, wherein effective constituent elements of ink which is refilled during said ink refilling step is lower in density than effective constituent elements of ink initially filled in the ink cartridge.

25. The method according to claim 15, further comprising:

a step of replacing a packing member positioned at said ink supply port with a new one subsequently to said cleansing fluid discharging step and prior to said ink refilling step.

26. The method according to claim 15, further comprising:

a step of detaching a packing member from said ink supply port prior to said negative pressure applying step.

27. The method according to claim 26, wherein said packing member is adapted to seal the ink supply port.

28. The method according to claim 15, further comprising:

a step of attaching a packing member to said ink supply port prior to said ink refilling step.

29. The method according to claim 28, wherein said packing member is adapted to seal the ink supply port.

30. The method according to claim 15, further comprising:

a step of detaching a packing member having a sealing function from said ink supply port prior to said negative pressure applying step;

a step of attaching said packing member or a new packing member having a sealing function to said ink supply port subsequently to said cleansing fluid discharging step and prior to said ink refilling step.

* * * * *